United States Patent [19]

Saurwein

[11] Patent Number: 4,820,136

[45] Date of Patent: Apr. 11, 1989

[54] FLUID PRESSURE INTENSIFYING SYSTEM

[76] Inventor: Albert C. Saurwein, 5 F St., SE., Auburn, Wash. 98002

[21] Appl. No.: 60,498

[22] Filed: Jun. 11, 1987

[51] Int. Cl.[4] ..... F04B 9/10; F15B 15/22

[52] U.S. Cl. ..... 417/397; 91/443; 91/445; 91/447; 91/463; 137/493.9

[58] Field of Search ..... 91/443, 445, 447, 448, 91/463; 417/397, 403, 404; 137/493.8, 493.9, 514.5

[56] References Cited

U.S. PATENT DOCUMENTS

| | | | |
|---|---|---|---|
| 2,590,769 | 3/1952 | Herrstrum | 91/443 X |
| 2,988,060 | 6/1961 | Arbogast | 91/443 |
| 3,107,688 | 10/1963 | Caslow | 137/514.5 X |
| 3,374,863 | 3/1968 | Kozlowski et al. | 417/397 |
| 4,132,153 | 1/1979 | Grotness et al. | 91/443 X |
| 4,555,976 | 12/1985 | Wolfges | 91/447 X |

FOREIGN PATENT DOCUMENTS

| | | | |
|---|---|---|---|
| 2738476 | 3/1978 | Fed. Rep. of Germany | 91/443 |

*Primary Examiner*—Leonard E. Smith

*Attorney, Agent, or Firm*—Harry M. Cross, Jr.

[57] ABSTRACT

A fluid pressure-intensifying system of the double-acting type has a recompression valve assembly that meters working fluid of the low pressure hydraulic cylinder to control low pressure piston travel upon reversal at the end of each pressure-intensifying stroke.

9 Claims, 3 Drawing Sheets

FLUID PRESSURE INTENSIFYING SYSTEM

FIELD OF THE INVENTION

This invention relates to high pressure fluid intensifier systems. More particularly, this invention relates to double-acting hydraulic intensifiers.

BACKGROUND OF THE INVENTION

In a typical high pressure fluid intensifier system, hydraulic fluid acts on a reciprocating double-acting, low pressure—high pressure piston assembly to compress water to several thousand psi. The piston assemblies of such systems are exposed to hydraulic fluid pressures on the order of 3,000 psi and to water pressures on the order of 20–60,000 psi. These assemblies must be designed to withstand tremendous pressure fluctuations while at the same time maintain hydraulic fluid/water separation.

The pressure chambers within which such a piston assembly works, and the various pressure seals incorporated in the assembly are severely stressed. The pressure chambers are often made up of members that are screwed and/or bolted together to resist cyclic pressure buildup and release. Replacement of the high pressure seals periodically is difficult because of the attachment of the various members making up the intensifier pressure chambers and piston assembly. Usually, the intensifier must be completely dismantled to reach and repair or replace internal elements.

SUMMARY OF THE INVENTION

The intensifier system of this invention comprises a double-acting fluid pressure intensifier, and a working fluid supply system for operating the intensifier. The supply system includes a working fluid source, a control valve for directing working fluid to the low pressure piston assembly contained within the intensifier, and a pair of recompression valves between the intensifier and the control valve. The recompression valves are connected into the low pressure hydraulic working fluid system to regulate cyclical piston reversal at the point of reversal. These valves, one being provided in communication with each end of the working piston chamber, meter the release of fluid from the working piston chamber at the point of piston reversal. These valves greatly reduce pressure spikes that would otherwise occur when a reversed high pressure piston is rammed into the unpressurized fluid in the high pressure chamber.

DESCRIPTION OF THE INVENTION

Figure 1:
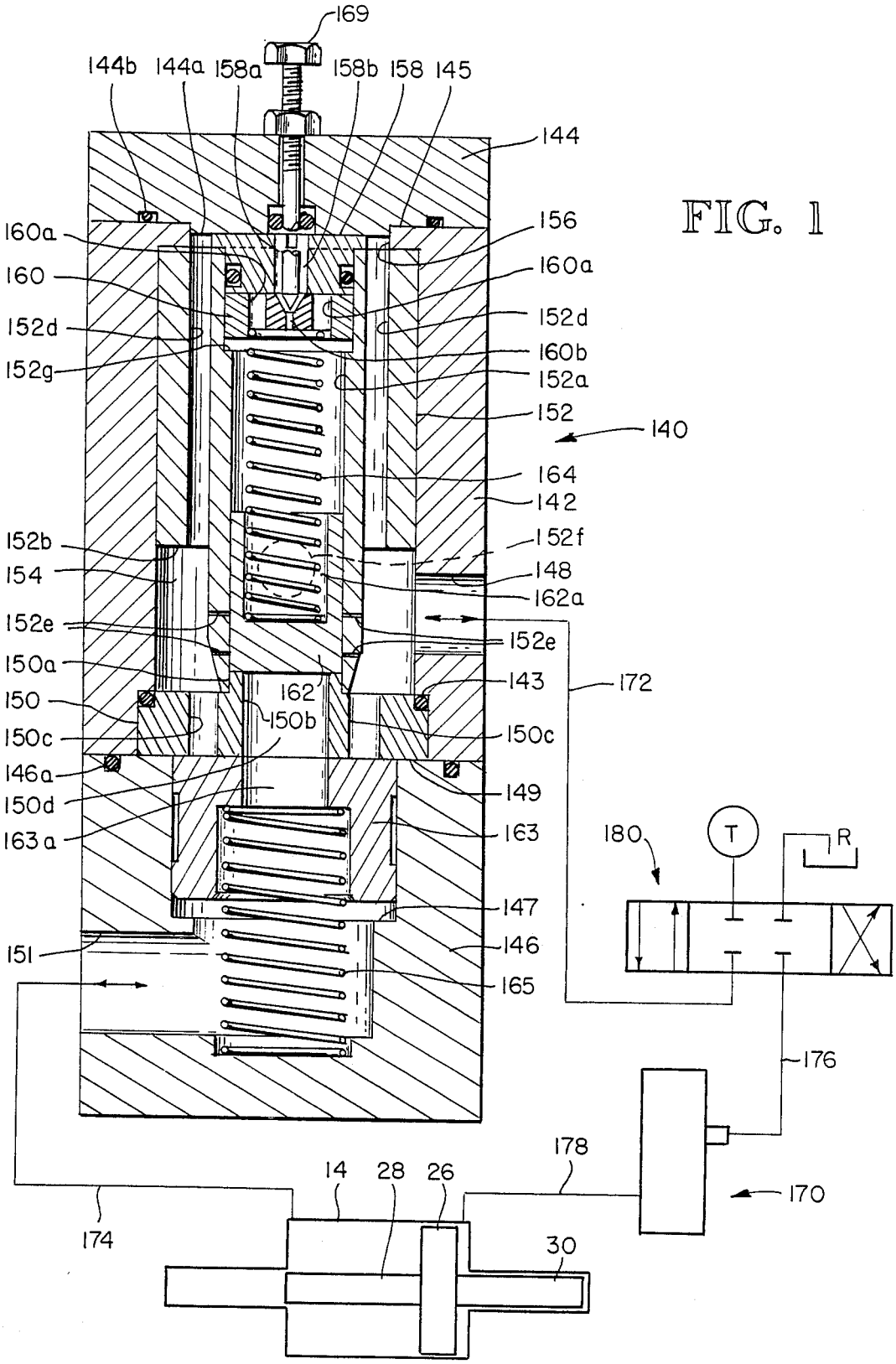
FIG. 1 is a cross section of the recompression valve shown in a hydraulic circuit schematic to illustrate its affect on the operation of an intensifier in one operative mode.

The intensifier of this invention utilizes hydraulic fluid (oil) to drive a high pressure - low pressure piston assembly to produce a high pressure water flow. The intensifier shown in FIG. 1 is double-acting.

The low pressure - high pressure piston assembly comprises a low pressure piston 26 and left and right hand high pressure pistons 28 and 30. The low pressure piston is a cylindrical disk contained within low pressure chamber 14. Its outer surface conforms to the inner surface of the low pressure cylinder with a small allowance for a slip-fit clearance, and mounts appropriate hydraulic pressure seals to seal one side of low pressure chamber 14 from the other. The high pressure pistons are connected to opposite faces of the low pressure piston 26 and extended through a respective cylinder block into high pressure chambers.

As high pressure piston rod 30 is retracted from the position shown, low pressure water is drawn into the respective high pressure chamber through an inlet check valve. When piston rod 30 is driven back to the position shown, the inlet check valve closes, water is compressed to a high pressure and then forced out through an outlet check valve.

Reciprocation of the high pressure piston is effected as a consequence of hydraulic fluid being pumped into low pressure chamber 14 on one side of low pressure piston 26 or the other. When hydraulic fluid is pumped through line 178 into chamber 14, low pressure piston 26 will be driven leftward from the position shown, thus retracting the right hand high pressure piston rod 30 and extending the left hand high pressure piston rod 28. Concurrently, hydraulic fluid will be vented through the hydraulic fluid line 174 and water in the left hand high pressure chamber will be compressed and forced out through the left hand outlet check valve. When low pressure piston 26 reaches the left end of low pressure chamber 14, hydraulic fluid flow will be reversed and low pressure piston 26 will be driven rightward. Hydraulic fluid will be vented through right hand hydraulic fluid line 178 and water in the right hand high pressure chamber will be compressed and forced out through the right hand outlet check valve.

The recompression valve system shown in FIG. 1 comprises two recompression valve assemblies 140 and 170 arranged in fluid communication with opposite sides of low pressure working fluid piston chamber 14 and working fluid control valve 180. The two recompression valve assemblies are identical, may be mirror images of one another, and are described herein with reference to assembly 140.

Recompression valve assembly 140 comprises a body member 142, an upper metering cylinder cap 144, and a lower metering piston cap 146. Body member 142 is machined to provide a stepped cylindrical cavity subdivided into upper and lower portions by an annular step 143, the top of the upper portion being rimmed by an inwardly-projecting annular rim 145. The body member is provided with a working fluid passage 148 into the lower third of the upper cavity. Upper cap 144 contains a downwardly-projecting cylindrical pilot **144*a*, the outer vertical periphery of which slip fits against the vertical periphery of annular rim 145. Upper cap 144 also contains a machined annular groove 144*b* in its bottom face into which an O-ring seal fits to seal the upper cap and body against working fluid leakage from the upper cavity portion. Lower cap 146 is machined to provide a cavity, the bottom of which is rimmed by an inwardly-projecting step 147, and a working fluid passage 151 into the bottom of the cavity. The upper and lower cavities in the body member 140 are axially adjacent and axially open to one another. The cavity in lower cap 146 and the body member lower cavity are axially adjacent and axially open to one another. The lower cap cavity is narrower than the body member lower cavity and the upper face of lower cap 146 provides an inwardly-projecting step 149, the upper annular surface of which faces the bottom of the body member lower cavity. Lower cap 146 also contains a machined annular groove 146*a*** into which an O-ring seal fits to seal the lower cap and body against working fluid leakage from the adjacent cavities.

Within the body 142, a cylindrical inflow orifice plate 150 occupies the lower portion of the body member cylindrical cavity. Plate 150 bears against the annular step 143 and has a bottom face that is co-planar with the bottom edge of body 142. The upper edge surface of lower cap 146 bears against the bottom face of plate 150 to secure plate 150. Plate 150 is disk shaped with an upwardly-projecting cylindrical axial stub **150*a* which centers and supports a metering cylinder 152 (to be described hereinafter). The plate 150 is provided with a vertical axial working fluid passage 150*b* that extends through the center of stub 150*a*. A ring of individual small orifice passages 150*c* (two being shown), preferably eight in number, encircle stub 150*a* but are spaced radially outward a sufficient distance to provide a seating surface for the lower edge of metering cylinder 152 adjacent the side surface of stub 150*a*. These metering orifices provide for working fluid communication between the upper portion of the body cavity and the cavity in lower cap 146**.

Metering cylinder 152 occupies the upper portion of the body cavity. It is machined to have a larger outer diameter over its upper two thirds to closely fit the confines of the body cavity upper portion. It is machined to have a smaller outer diameter over its lower third. The metering cylinder bears against and extends from the body member rim 145 down to the upper face of the cylindrical inflow orifice plate 150. An annular space 154 is provided between the smaller outer diameter of the lower third of metering cylinder 152 and the inner surface of the body 142, bounded at the top by the lower edge **152*b* of larger-diametered upper two thirds of metering cylinder 152 and bounded at the bottom by inflow orifice plate 150. Metering cylinder 152 is provided with an elongated vertical interior axial cylindrical passage 152*a* that extends through the entire cylinder. Passage 152*a* has a diameter equal to the outer diameter of orifice plate stub 150*a*. The wall thickness of the lower smaller-diametered third of metering cylinder 152 may be such that the lower end of metering cylinder 152 must be tapered inwardly as shown to reduce its bottom edge to a thickness compatible with the width of the seating surface on orifice plate 150 so that metering passages 150*c* are not obstructed by that bottom edge. The larger-diametered upper two thirds of metering cylinder 152 is provided with diametrically-opposed vertical small orifice passages 152*d* that extend full length to provide fluid communication between space 154 and an annular space 156. Space 156 is defined between body upper rim 145 and a metering cylinder cap 158 (to be described hereinafter) and bounded at the top by pilot stub 144*a* and at the bottom by the upper face of metering cylinder 152. The wall of the lower half of the smaller-diametered metering cylinder lower third is provided with a plurality of small metering holes 152*e* (see FIGS. 1 and 5) and the wall of the upper half of that lower third is provided with a fluid passage 152*f*, all of which provide fluid communication between the metering cylinder interior passage 152*a* and surrounding space 154**.

The upper portion of metering cylinder inner passage **152*a* is machined to a larger internal diameter to provide an annular shoulder 152*g* (FIG. 1). Within this upper portion, an orifice poppet metering piston 160 is positioned with sufficient clearance to travel vertically between the shoulder 152*g* and the overhead metering cylinder cap 158. This cap 158 is machined to provide an upper fluid distributing layer having a thickness equal to the depth of the adjacent annular space 156. This cap 158 is machined to provide a depending plug that extends into the upper portion of metering cylinder passage 152 to interact with poppet piston 160. The rim of the upper layer of cap 158 seats on the annular upper ledge of metering cylinder 152 just radially inward of metering passages 152*d* as shown. The upper layer of cap 158 is cross-grooved by two grooves 158*a* (FIG. 1) diametrically intersecting at 90° and communicating with an axially fluid distribution passage 158*b* (FIG. 1) that extends vertically through cap 158. Poppet piston 160 is provided with four metering passages 160*a* (FIG. 1, two being shown) extending vertically through poppet piston 160, arranged in a ring and spaced 90° apart. Poppet piston 160 is also provided with an axial metering passage 160*b* (FIG. 1) extending through piston 160. Passages 160*a* and 160*b* are in fluid communication with metering cylinder internal passage 152*a* and axial passage 160*b* is also in fluid communication with cap axial passage 158*b*. Piston passages 158*a* are arranged radially such that their upper openings are sealed by the undersurface of cap 158 when poppet piston 160 bears against that undersurface as shown in FIG. 1. Cap 158 is secured in position by plug 144*a* of upper cap 144 and is machined to provide a peripheral groove containing an O-ring seal to prevent fluid leakage between cap 158 and metering cylinder 152**.

A cylindrical metering piston 162 slidably fits within metering cylinder 152 as shown in FIG. 1. Piston 162 is partially counterbored from the top to provide an upwardly-opening well **162*a* (FIG. 1) for receipt of a helical spring 164. Spring 164 extends from the base of well 162*a* upward into a recess in the underside of poppet piston 160. Spring 164 exerts sufficient force against poppet piston 160 and piston 162 to seat them against, respectively, cap 158 and orifice plate 150. When seated on the upper edge of plate 150 as shown in FIG. 1, the underside of piston 162 seals an axial fluid passage 150*b*, in plate 150 to prevent fluid communication between passage 150*b* and the metering cylinder inner passage 152*a***.

The cavity of lower cap 146 is machined to extend axially downward to rim 147 and continues downward until intersected by passage 151. Within the upper portion of the lower cap cavity, an inflow poppet 163 is positioned to reciprocate between rim 147 and orifice plate 150. Poppet 162 is a closed-end cylinder with its upper closed end provided with a fluid passage **162*a* providing fluid communication between the lower cap cavity and passage 150*b* in orifice plate 150. The outer closed-end surface of poppet 163 seats against the underside of orifice plate 150 to close off the metering passages 150***c* as shown in FIG. 1. A helical spring 165 extends from the lower portion of the lower cap cavity into poppet 162 to the inner surface of the poppet closed-end and exerts sufficient force against poppet 163 to seat it against the underside of orifice plate 150.

In FIG. 1, the system is shown at the instant that the intensifier working piston 26 reaches its rightward-most travel and reverses to travel leftward. At this instant the working fluid control valve 180 shifts leftward to permit application of tank pressure (working pressure) to the right side of working fluid piston 26 to drive piston 26 leftward, and to permit the working fluid on the left side of piston 26 to exhaust to reservoir as piston 26 is forced leftward. If recompression valve 140 were absent, at the instant of working piston reversal, the intensifier system would undergo a substantial stress spike as working piston 26 suddenly shifted leftward until high pressure piston 28 recompressed the water in the left-hand high pressure chamber back up to the specified high system pressure, and then abruptly stopped when the volume of water in the high pressure chamber became incompressible. In a typical intensifier system, the suddenly-shifted working piston 26 travels about 0.4 inches in about 60 microseconds before being abruptly stopped. The resulting stress spike substantially reduces the lifespan of the intensifier.

With recompression valve 140 present, however, the working piston 26 does not suddenly shift and then abruptly stop. When control valve 180 shifts leftward, working fluid under tank pressure is applied to the right side of working piston 26, passage 148 in valve body 142 is placed in fluid communication with the reservoir R at exhaust pressure through fluid line 172, and passage 151 in lower cap 146 is in fluid communication with working fluid chamber 14 at working fluid tank pressure through fluid line 174. To recapitulate, passage 148 is at reservoir exhaust pressure and passage 151 is at working fluid tank pressure. Consequently, at the instant of the reversal of working piston 26, the recompression valve elements are positioned as shown in FIG. 1.

As working piston 26 begins to travel leftward, working fluid in low pressure chamber 14 on the left side of working piston 26 is forced out of low pressure chamber, through line 174 into passage 151, and through passages 162*a* and 150*b* against the underside of metering piston 162. This forces metering piston 162 upward, overcoming the spring force of spring 164. Working fluid in metering cylinder internal passage 152*a*, above metering piston 162, is vented upward through axial metering passage 160*b* in poppet piston 160, through axial distribution passage 158*b* and intersecting grooves 158*a* in cap 158 into annular space 156, down through the pair of metering passages 152*d* in metering cylinder 152 into space 154 and out through passage 148 to line 172, and thence to reservoir R.

Figure 5:
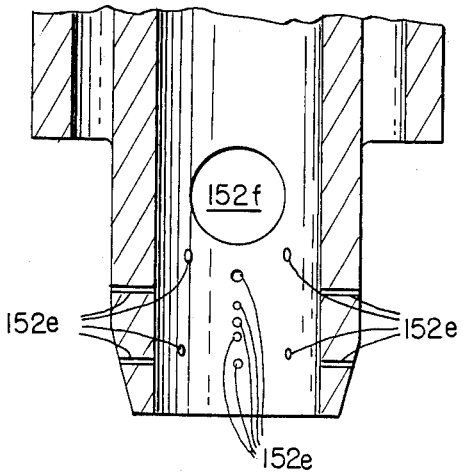
FIG. 5 is a simplified view of a hydraulic fluid manifold containing two FIG. 1 type recompression valves and mounting the hydraulic fluid control valve.
Figure 6:
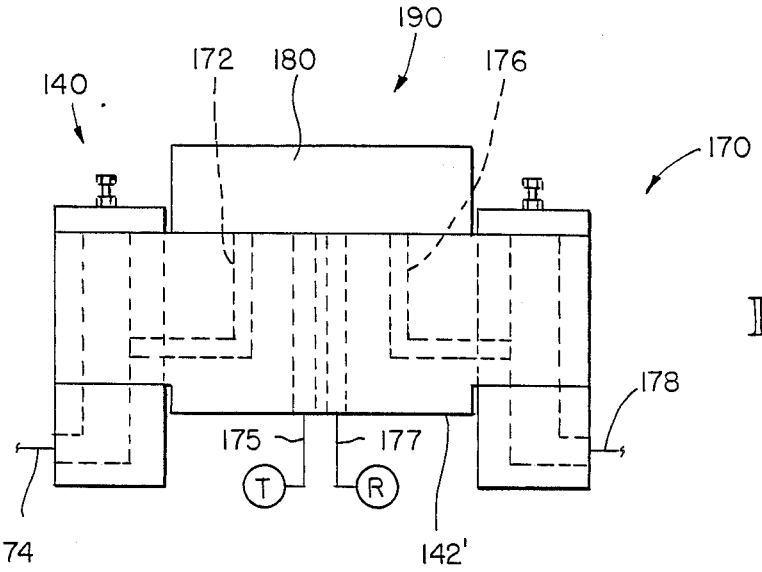
FIG. 6 illustrates the recompression valves provided in a manifold assembly.

The rate at which metering piston 162 moves upward is dependent on the restricted size of metering passage 160*b* in poppet piston 160. Fine tuning of the rate can be achieved by adjusting a metering screw sub-assembly 169 (FIG. 1) to restrict or expand the flow through passage 160*b*. At whatever the rate, metering piston 162 moves upward and the volume of working fluid leaving the intensifier low pressure chamber 14 equals the volume of working fluid passing through metering passage 160*b*. As metering piston 162 moves upward, the series of metering holes 152*e* in metering cylinder 152 are exposed and working fluid passes therethrough into space 154 and passage 148 to line 172 and thence to reservoir R. These metering holes 152*e* are progressively exposed as metering piston 162 travels upward so that a progressively greater volume of working fluid leaves the intensifier low pressure chamber 14 through line 174. Consequently, low pressure piston 26 travels leftward at a progressively more rapid rate. As can be seen in FIG. 5, the metering holes 152*e* are grouped at various elevations to provide a working fluid venting profile to suit the required dynamics of the working piston 26 traveling leftward at the beginning of its intensifying pressurization cycle.

Figure 2:
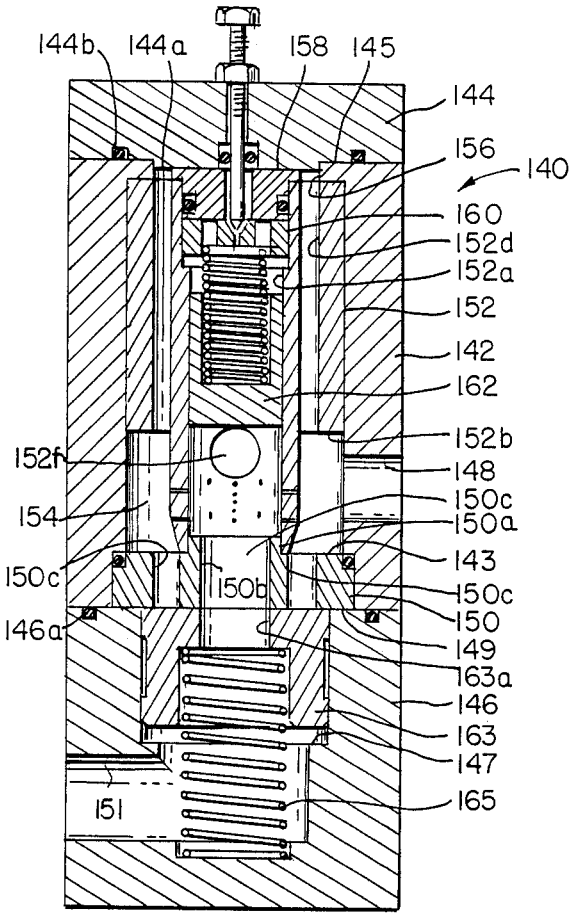
FIG. 2 is a cross section of the FIG. 1 recompression valve in a second operative mode.
Figure 4:
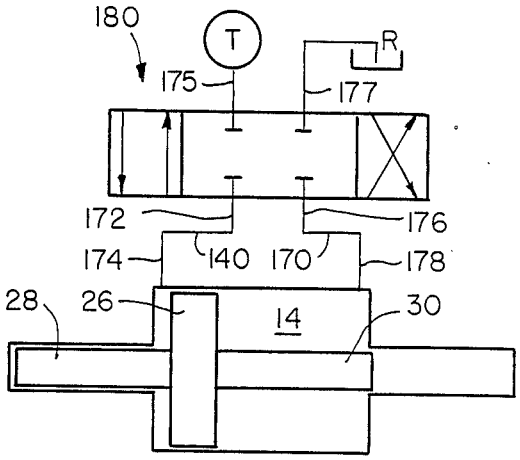
FIG. 4 is a partial enlarged view in cross section illustrating the hydraulic fluid metering feature of the FIG. 1 recompression valve.

Finally, metering piston 162 moves upward far enough to expose fluid passage 152*f* in metering cylinder 152, thereby permitting comparatively unrestricted flow of working fluid through passage 152*f* into space 154, and through passage 148 and line 172 to reservoir R. This condition of the recompression valve 140 is shown in FIG. 2. There is still sufficient pressure in the working fluid within working cylinder 152 below metering piston 162, before it undergoes a pressure drop through passage 152*f*, to overcome the spring force of spring 164 and to maintain metering piston 162 in the raised position shown in FIG. 2 throughout the balance of the leftward travel of working piston 26. When metering piston 162 clears all of the metering holes 152*e*, the intensifier working piston 26 will have traveled leftward far enough for high pressure piston 28 to have pre-compressed the water in the intensifier lefthand high pressure chamber. Thereafter, the working piston 26 can be permitted to travel leftward at full design speed. From the time that working piston reversal occurred and metering piston 162 reached the piston shown in FIG. 2, about 60 microseconds, the working piston 26 will have traveled 0.3–0.4 inches. In the preferred design, the recompression valve 140 meters working fluid exhausting from the leftside of low pressure chamber 14 in such a way that the load imposed on the left side of working piston 26, when added to the progressively increasing high pressure piston load, will equal the specified intensifier system pressure. The variable metering that occurs as more metering holes 152*e* are exposed, reduces the working fluid pressure linearly and permits the working piston 26 to advance leftward at a constant velocity.

Figure 3:
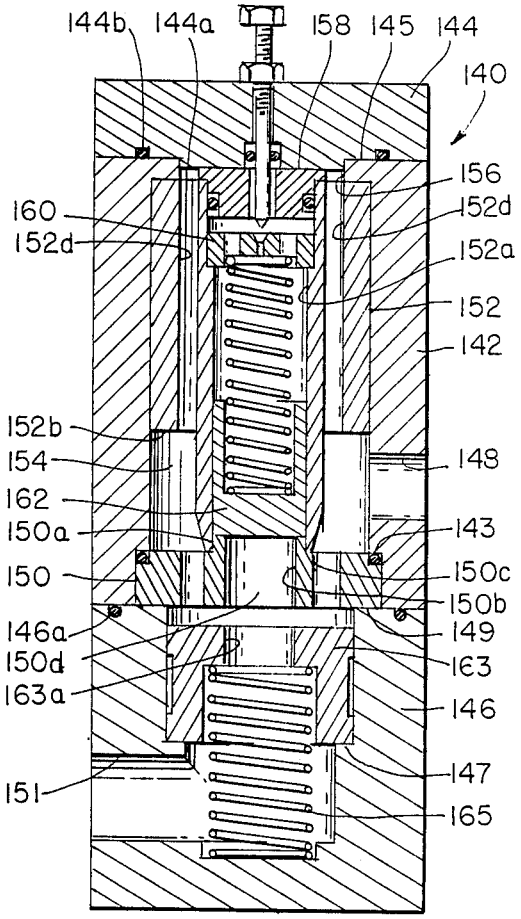
FIG. 3 is a cross section of the FIG. 1 recompression valve in a third operative mode.

When working piston 26 reaches the end of the leftward stroke, control valve 180 shifts to return the working piston 26 rightward. When control valve shift occurs, recompression valve 170 commences to function in the manner described above with respect to valve 140. Upon this reversal, passage 148 in valve body 142 becomes a pressure port and not a venting port. Tank pressure is applied to passage 148 through line 172 and transmitted through passages 152*d*, annulus 156, intersected grooves 158*a* and distribution passage 158*b*. Distribution passage 158*b* opens axially onto poppet piston 160 and tank pressure, aided by the spring 164, forces poppet piston 160 down against rim stop 152*g* as shown in FIG. 3 to expose metering passages 160*a*. Working fluid at tank pressure then flows through passages 160*a* and moves metering piston 162 from the position shown in FIG. 2 to the position shown in FIG. 3, closing off passage 152*f* and metering holes 152*e*.

Working fluid at tank pressure also is directed from passage 148 and space 154 through orifice passages 150*c* in metering plate 150 against the upper surface of inflow poppet 163. Under tank pressure, inflow poppet 163 shifts downward against rim stop 147 to place passage 163*a* in fluid communication with orifice passages 150*c*. Consequently, working fluid now passes from tank T through line 172, passage 148 and space 154, through passages 150*c* and 163*a*, and out through passage 151 and line 174 to the left side of low pressure chamber 14.

In a preferred form of the recompression valve assembly, both valves 140 and 170 are incorporated into a manifold assembly 190 as shown in FIG. 12. A common manifold body 142′ provides a common valve body for both valves 140 and 170, fluid distribution lines to control valve 180 and to T and R, and a mounting for control valve 180.

While a preferred embodiment of an intensifier, made in accordance with the principles of the present invention, has been described and illustrated, certain changes may be made without departing from the scope of the invention.

I claim:

1. A recompression valve for regulating working fluid flow into and out of a hydraulic working fluid cylinder comprising a valve assembly having a valve body with a first passage in fluid communication with said control valve and a second passage in fluid communication with said one side of said low pressure chamber, and a metering cylinder having an interior defining a metering chamber in fluid communication with both first; and second passages, said metering cylinder having a plurality or apertures in its cylindrical wall providing fluid communication between said metering chamber and said first passage:

an inlet element means within said valve body in fluid communication with and between said first and second passages responsive to working fluid pressure to permit working fluid to either (a) flow from said control valve to said low pressure chamber when working fluid is directed to pressurize said one side of said low pressure chamber, or (b) flow from said low pressure chamber to an outlet element when working fluid is vented from said one side of said low pressure chamber;

an outlet element means located in said metering chamber between said inlet element means and said first passage responsive to working fluid pressure and so arranged as to normally seal said apertures from fluid communication with said metering chamber but in response to working fluid pressure will shift to expose the metering cylinder apertures to vent working fluid to permit working fluid to flow from said second passage to said first passage solely through said metering chamber when venting said one side of said low pressure chamber; and a metering element means located in said metering chamber and so arranged as to control the position of said outlet element means in response to reduced working fluid pressure in said first passage whereby said flow through said metering chamber to said first passage occurs at a progressively greater rate as working fluid is initially vented from said one side of said working chamber.

2. The recompression valve means of claim 1 wherein said valve assembly comprises: a valve body within which said inlet element means, outlet element means, and said metering element means are axially aligned; and wherein said valve assembly includes an orifice plate separating said metering cylinder from said inlet element means and being provided with orifice passage therein in fluid communication with said first passage, said inlet element means being normally seated against said orifice plate to seal said orifice passages from fluid communication with said second passage, and said inlet element means and said orifice plate being provided with axially-aligned center passages providing fluid communication between said second passage and said outlet element whereby, when said inlet element means is sealed against said orifice plate and working fluid begins to vent from said low pressure chamber, working fluid pressure will shift said outlet element means to expose the metering cylinder apertures to venting working fluid at a rate determined by said metering element means.

3. The recompression valve of claim 2 wherein said valve assembly comprises an orifice plate separating said metering cylinder from said inlet element means having orifice passage therein in fluid communication with said first passage, said inlet element means being normally seated against said orifice plate to seal said orifice passages from fluid communication with said second passage, and said inlet element means and said orifice plate being provided with axially-aligned center passages providing fluid communication between said second passage and said outlet element means whereby, when said inlet element means is sealed against said orifice plate venting working fluid will pass through the aligned center passages into said metering cylinder and out through said metering cylinder apertures.

4. In a fluid pressure intensifying system comprising a source for supplying low pressure working fluid to a low pressure working fluid chamber; a control valve for directing working fluid to and from alternate sides of a low pressure reciprocating piston in said low pressure chamber; and a double-acting fluid pressure intensifier having a low pressure working fluid chamber and two high pressure fluid chambers, a low pressure reciprocating piston in said working fluid chamber and a high pressure reciprocating piston in each high pressure fluid chamber, the low and high pressure pistons being so arranged that low pressure fluid acting alternately on one side and then the other side of said low pressure piston will cause first one high pressure piston and then the other to compress fluid to a high pressure in its chamber and cause the other high pressure piston to evacuate its chamber to permit fluid to enter therein for pressurization on the next stroke; the improvement comprising:

recompression valve means in fluid communication with said control valve and one side of said low pressure chamber which comprises inlet valve means for direction working fluid under pressure from said control valve into said low pressure chamber to act on one side of said low pressure piston to cause a high pressure piston to compress the fluid in its high pressure chamber to a high pressure; outlet valve means for venting working fluid from said one side of said low pressure chamber to said control valve including metering means for regulating the venting of working fluid through said outlet valve means so as to control the reduction of working fluid pressure when working fluid is vented from said low pressure chamber at the beginning of a piston stroke whereby a pressure spike-causing sudden movement of said low pressure piston on its reversal is avoided, said recompression valve means comprising a valve assembly having a valve body with a first passage in fluid communication with said control valve and a second passage in fluid communication with said one side of said low pressure chamber, and a metering cylinder having an interior defining a metering chamber in fluid communication with both first and second passages, said metering cylinder having a plurality of aperture in its cylindrical wall providing fluid communication between said metering chamber and said first passage;

an inlet element means within said valve body in fluid communication with and between said first and second passages responsive to working fluid pressure to permit working fluid to either (a) flow from said control valve to said low pressure chamber when working fluid is directed to pressurize said one side of said low pressure chamber, or (b) flow from said low pressure chamber to an outlet element when working fluid is vented from said one side of said low pressure chamber;

an outlet element means located in said metering chamber between said inlet element means and said first passage responsive to working fluid pressure and so arranged as to normally seal said apertures from fluid communication with said metering chamber but in response to working fluid pressure will shift to expose the metering cylinder apertures to vent working fluid to permit working fluid to flow from said second passage to said first passage solely through said metering chamber when venting said one side of said low pressure chamber; and a metering element means located in said metering chamber and so arranged as to control the position of said outlet element means in response to reduced working fluid pressure in said first passage whereby said flow through said metering chamber to said first passage occurs at a progressively greater rate as working fluid is initially vented from said one side of said working chamber.

5. The recompression valve means of claim 4 wherein said inlet element means, outlet element means, and said metering element means are axially aligned; and wherein said valve assembly includes an orifice plate separating said metering cylinder from said inlet element means and being provided with orifice passages therein in fluid communication with said first passage, said inlet element means being normally seated against said orifice plate to seal said orifice passages from fluid communication with said second passage, and said inlet element means and said orifice plate being provided with axially-aligned center passages providing fluid communication between said second passage and aid outlet element whereby, when said inlet element means is sealed against said orifice plate and working fluid begins to vent from said low pressure chamber, working fluid pressure will shift said outlet element means to expose the metering cylinder apertures to venting working fluid at a rate determined by said metering element means.

6. The recompression valve of claim 4 wherein said valve assembly comprises an orifice plate separating said metering cylinder from said inlet element means having orifice passages therein in fluid communication with said first passage, said inlet element means being normally seated against said orifice plate to seal said orifice passages from fluid communication with said second passage, and said inlet element means and said orifice plate being provided with axially-aligned center passages providing fluid communication between said second passage and said outlet element means whereby, when said inlet element means is sealed against said orifice plate venting working fluid will pass through the aligned center passages into said metering cylinder and out through said metering cylinder apertures.

7. The recompression valve means of claim 4 comprising a pair of said valve assemblies so arranged that when one assembly is directing working fluid to one side of said low pressure chamber the other assembly is directing working fluid from the other side of said low pressure chamber.

8. The recompression valve means of claim 7 wherein each valve assembly inlet element means, outlet element means, and said metering element means are axially aligned; and wherein each said valve assembly includes an orifice plate separating said metering cylinder from said inlet element means and being provided with orifice passages therein in fluid communication with said first passage, said inlet element means being normally seated against said orifice plate to seal said orifice passages from fluid communication with said second passage, and said inlet element means and said orifice plate being provided with axially-aligned center passages providing fluid communication between said second passage and said outlet element whereby, when said inlet element means is sealed against said orifice plate and working fluid begins to vent from said low pressure chamber, working fluid pressure will shift said outlet element means to expose the metering cylinder apertures to venting working fluid at a rate determined by said metering element means.

9. The recompression valve of claim 7 wherein each said valve assembly comprises an orifice plate separating said metering cylinder from said inlet element means having orifice passages therein in fluid communication with said first passage, said inlet elements means being normally seated against said orifice plate to seal said orifice passage from fluid communication with said second passage, and said inlet element means and said orifice plate being provided with axially-aligned center passages providing fluid communication between said second passage and said outlet element means whereby, when said inlet element means is sealed against said orifice plate venting working fluid will pass through the aligned center passages into said metering cylinder and out through said metering cylinder apertures.

* * * * *